US008585022B2

(12) United States Patent
Lee

(10) Patent No.: US 8,585,022 B2
(45) Date of Patent: Nov. 19, 2013

(54) VAPOR GENERATING APPARATUS IN THE WATER

(71) Applicant: Sang-Yeol Lee, Busan (KR)

(72) Inventor: Sang-Yeol Lee, Busan (KR)

(73) Assignees: Sang-Yeol Lee (KR); Sheila Jihyun Lee (KR)

( * ) Notice: Subject to any disclaimer, the term of this patent is extended or adjusted under 35 U.S.C. 154(b) by 0 days.

(21) Appl. No.: 13/675,236

(22) Filed: Nov. 13, 2012

(65) Prior Publication Data

US 2013/0069255 A1 Mar. 21, 2013

Related U.S. Application Data

(63) Continuation of application No. PCT/KR2012/003581, filed on May 8, 2012.

(30) Foreign Application Priority Data

Aug. 12, 2011 (KR) ..... 10-2011-0080393

(51) Int. Cl.
*B01F 3/04* (2006.01)

(52) U.S. Cl.
USPC ..... 261/29; 261/108; 261/110; 261/123

(58) Field of Classification Search
USPC ..... 261/28, 29, 108, 110, 123
See application file for complete search history.

(56) References Cited

U.S. PATENT DOCUMENTS

| | | | | |
|---|---|---|---|---|
| 5,938,982 | A * | 8/1999 | Sugiura | 261/75 |
| 7,059,591 | B2 * | 6/2006 | Bortkevitch et al. | 261/76 |
| 7,338,551 | B2 * | 3/2008 | Kozyuk | 95/175 |
| 8,201,811 | B2 * | 6/2012 | Cunningham et al. | 261/29 |
| 2003/0201552 | A1 * | 10/2003 | Chuang | 261/62 |
| 2007/0095937 | A1 * | 5/2007 | Noguchi et al. | 239/290 |
| 2009/0273103 | A1 * | 11/2009 | Watanabe | 261/5 |
| 2010/0104705 | A1 * | 4/2010 | Gordon et al. | 426/238 |

* cited by examiner

*Primary Examiner* — Charles Bushey
(74) *Attorney, Agent, or Firm* — Park & Associates IP Law P.C.

(57) ABSTRACT

An apparatus for generating microbubbles in water from a mixed fluid in which a gas and a liquid are mixed. The apparatus includes a cylindrical body which includes an inlet coupled to a hose, an outlet, and a cylindrical space section defined therein. The diameter of the space section is greater than each diameter of the inlet and the outlet. An inner container member is fixed in the space section such that a tubular passage is formed. A circular first collision section is provided on the inner container member. The mixed fluid that has been introduced through the inlet collides against the first collision section and is thus stirred. An "L" shaped second collision section is provided on the inner corner of the body adjacent to the outlet. The mixed fluid that has passed through the passage collides against the second collision section and is thus stirred.

2 Claims, 3 Drawing Sheets

VAPOR GENERATING APPARATUS IN THE WATER

This is a continuation of pending International Patent Application PCT/KR2012/003581 filed on May 8, 2012, which designates the United States and claims priority of Korean Patent Application No. 10-2011-0080393 filed on Aug. 12, 2011, the entire contents of which are incorporated herein by reference.

FIELD OF THE INVENTION

The present invention relates, in general, to an apparatus for generating microbubbles in water, and more particularly, to an apparatus for generating microbubbles in water in which a mixed fluid in which a gas and a liquid are mixed is introduced into a body, so that microbubbles can be produced due to the inner structure of the body which causes changes in the volume and flow rate pressure of the mixed fluid and pressurization and decompression to the mixed fluid, and in which microbubbles can be generated since the mixed fluid collides against first and second collision sections positioned inside the body.

BACKGROUND OF THE INVENTION

A typical apparatus for generating microbubbles from a liquid by injecting gas into the liquid was introduced as follows.

In an example, Japanese Laid-Open Patent Publication No. 2006-116365 discloses "a bubble generator" which generates a mixed fluid by mixing gas into a liquid, as shown in FIG. 1.

FIG. 1 shows a cross-sectional view of the bubble generator of the related art. Referring to FIG. 1, the bubble generator includes a container body 100 having a cylindrical space, an air inlet 120 opened at one end side of the body, and a pressurized liquid inlet 140 formed in the outer circumference of the body. A gun protrudes inward from a part of the body that is adjacent to the air inlet 120 so as to form a conical or truncated conical shape 160. With this configuration, gas and liquid are mixed while being circulated inside the bubble generator, thereby forming microbubbles.

Microbubbles generated using such a bubble generator are characterized by a large specific surface area due to their small bubble size, a high inner pressure, absorptivity, and the like. Microbubbles are expected to have the effects such as water purification, physiological activation, an increase in agricultural productivity, energy savings, a decrease in frictional resistance, and the like. Therefore, studies for the application thereof are underway.

For example, microbubbles can be used for effective treatment of waste water, an increase in agricultural productivity, semiconductor cleaning, and the like. It is also possible to generate microbubbles in warm water in a bath so that the water becomes hazy like milk. This can produce the effect of bathing in a hot spring which moisturizes the skin.

Referring to FIG. 1, the bubble generator of the related art employs a structure which generates a vortex inside the bubble generator using a circulation pump.

However, the bubble generator of the related art has problems in that the generator is limited to a low-concentration type since the average diameter of bubbles that are generated thereby ranges from 30 μm to 200 μm, and in that the size and amount of bubbles are not suitably adjusted for the purpose of use.

SUMMARY OF THE INVENTION

Accordingly, the present invention has been made keeping in mind the above problems occurring in the related art, and is intended to provide an apparatus for generating microbubbles in water which can generate bubbles having an optimal diameter and concentration which are suitable for the purpose of use.

Also provided is an apparatus for generating microbubbles in water which can adjust the speed of a mixed fluid by changing the volume so that the diameter and concentration of bubbles can be varied.

In an aspect, the present invention provides an apparatus for generating microbubbles in water which generates microbubbles from a mixed fluid in which a gas and a liquid are mixed, the mixed fluid being supplied from the outside. The apparatus includes a body having a cylindrical shape, the body including an inlet in one side thereof which is coupled to a hose through which the mixed fluid is introduced, an outlet in the other side thereof, and a cylindrical space section defined therein, the diameter of the space section being greater than each diameter of the inlet and the outlet; an inner container member fixed in the space section such that a tubular passage is formed; a first collision section having a circular cross-section, the first collision section being provided on the inner container member in the inlet side direction such that the mixed fluid that has been introduced through the inlet collides against the first collision section and is thus stirred; and a second collision section having an "L" shape, the second collision section being provided on an inner corner of the body adjacent to the outlet such that the mixed fluid that has been introduced through the inlet and has passed through the passage collides against the second collision section and is thus stirred.

It is characterized in that a through-hole is formed in an outer circumference of the body.

It is also characterized in that a tubular flow rate adjustment member is provided on the outer circumference of the body and is horizontally movable along the outer circumference of the body so as to close or open the through-hole.

It is further characterized in that each of the first and second collision sections has protrusions on an outer surface thereof.

According to the invention configured as described above, the following effects can be expected.

First, since the cross-sectional area of the inlet and the outlet is smaller than the cross-sectional area of the inner space sections of the body, the mixed fluid that has been introduced into a greater volume of the space section is decompressed so that microbubbles are generated.

In addition, the mixed fluid collides against the inner container member which is provided in the space section of the body and is thus stirred, thereby enhancing creation of microbubbles.

Furthermore, the flow rate adjustment member is provided on the outer circumference of the body, and the size of the opened area of the through-hole which is a passage for liquid that can enter the body can be adjusted using the flow rate adjustment member. Thus it is also possible to advantageously adjust the diameter and concentration of bubbles by adjusting variation in the volume of the inner space section of the body.

DETAILED DESCRIPTION OF THE INVENTION

Hereinafter an exemplary embodiment of the invention is described with reference to the accompanying drawings.

Figure 1:
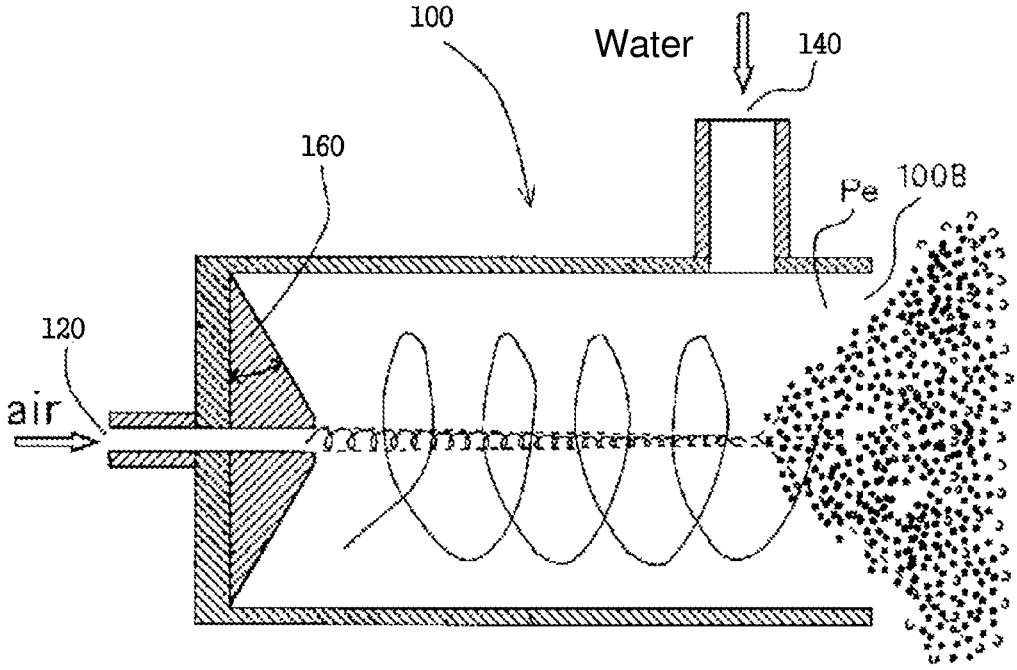
FIG. 1 (Prior Art)
FIG. 1 is a cross-sectional view of a bubble generator of the related art.
Figure 2:
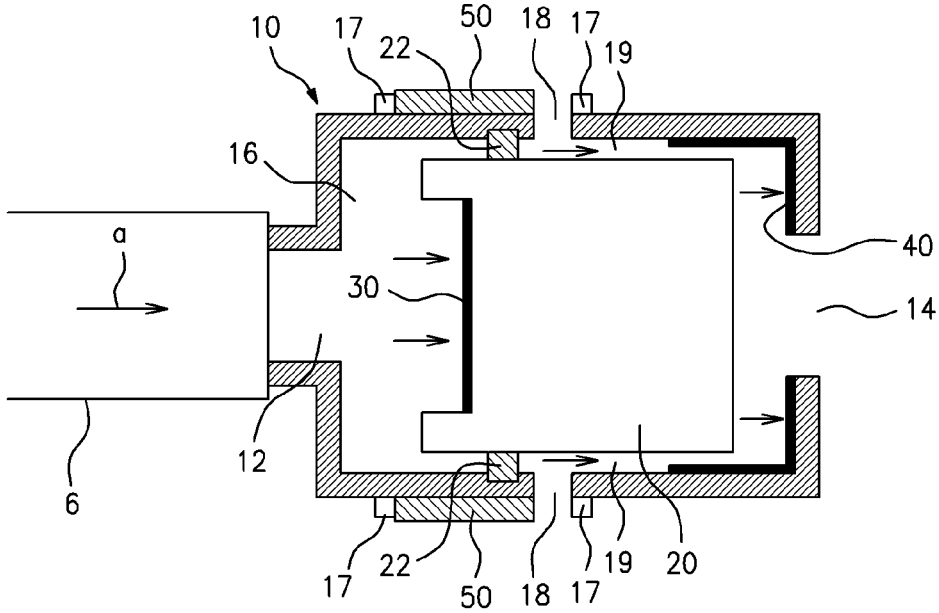
FIG. 2 is a cross-sectional view of an apparatus for generating microbubbles in water.
Figure 3:
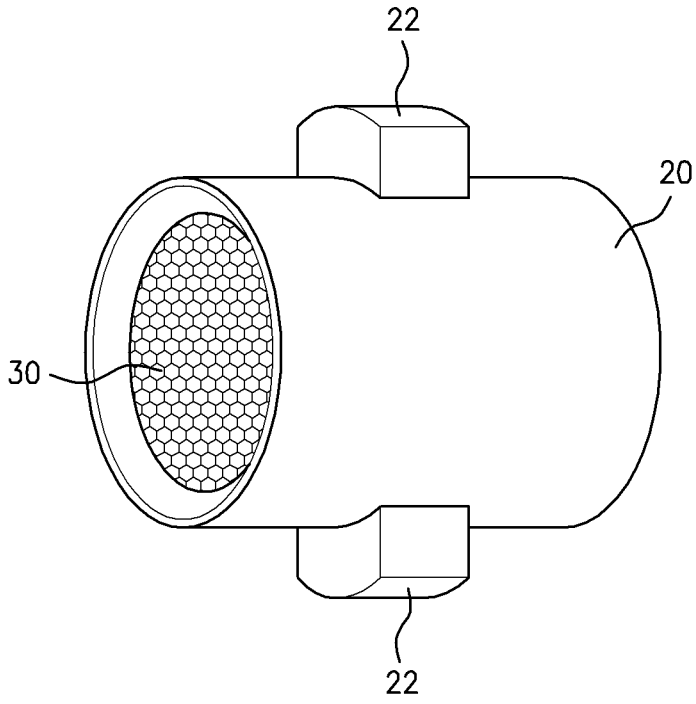
FIG. 3 is a detailed view of the inner container member shown in FIG. 2.
Figure 4:
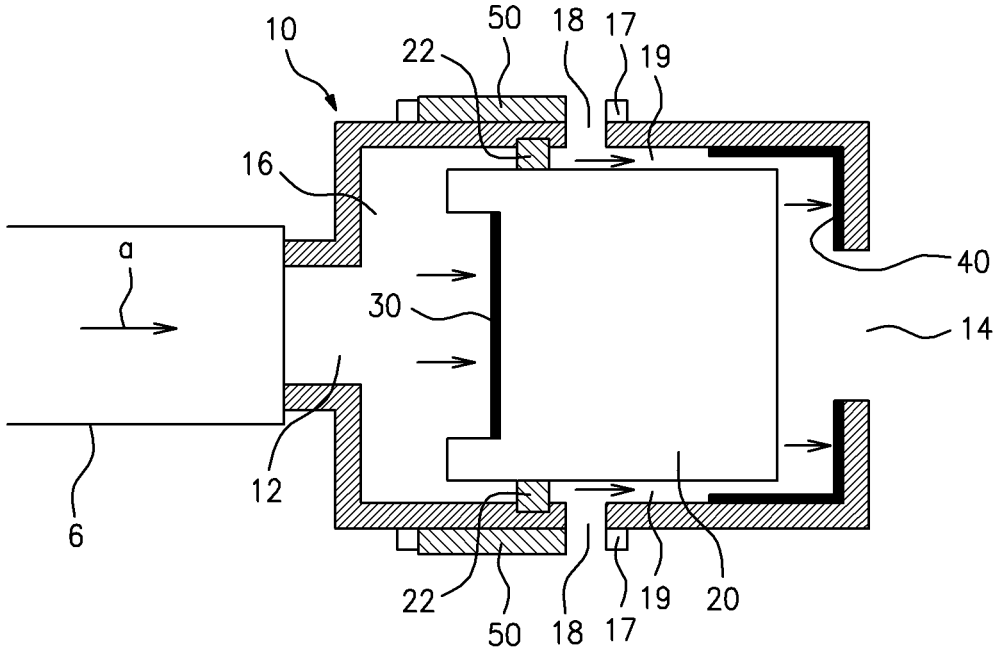
FIG. 4 is a front elevation view of FIG. 2.

FIG. 2 is a cross-sectional view of an apparatus for generating microbubbles in water, FIG. 3 is a detailed view of the inner container member shown in FIG. 2, and FIG. 4 is a front elevation view of FIG. 2.

Referring to FIG. 2, the apparatus for generating microbubbles in water generates microbubbles from a mixed fluid in which a gas and a liquid are mixed, the fluid being supplied from the outside. The apparatus generally includes a body 10, an inner container member 20, a first collision section 30, and a second collision section 40.

In the following description, 'liquid' refers to tap water, water from a river or a watercourse, seawater, pure water, liquid fuel, or the like, and 'gas' refers to natural air, oxygen, nitrogen, ozone, carbon gas, or the like.

First, the body 10 is disposed in water, and has an inlet 12, an outlet 14, and a space section 16.

The inlet 12 is formed in one side of the body 10 and is coupled with a hose 6 through which a mixed fluid "a" is introduced, such that the mixed fluid "a" enters the body 10 through the inlet.

The outlet 14 is formed in the other side of the body 10, such that the mixed fluid "a" that has entered the space section 16 is discharged in the form of microbubbles through the outlet 14.

The space section 16 has a cylindrical shape that is defined by the inner space of the body 10. The space section 16 is formed to be larger than the diameter of the inlet 12 such that the pressure of the mixed fluid "a" that has been introduced through the inlet 12 can be reduced depending on variation in the volume of the mixed fluid "a".

This makes it possible to generate microbubbles by extracting dissolved gas from the decompressed mixed fluid.

Here, the diameter of the space section 16 is set to be greater than the diameter of the outlet 14 such that the mixed fluid collides against the space section before exiting through the outlet 14.

The inner container member 20 is fixedly disposed with the shape of a cylinder such that a tubular passage 19 is formed in the space section 16. With this configuration, the volume of the space section 16 is variable.

Here, a bar-shaped fixing member 22 is provided on the outer circumference of the inner container member 20 and on the inner circumference of the body 10 in order to fix the inner container member 20 to the space section 16 such that the passage 19 is formed therebetween.

Specifically, the volume of the space section 16 at the side of the inlet 12 is increased, the space section 16 at the side of the inner container member 20 forms the passage 19 which has a decreased volume, and the volume of the space section 16 at the side of the outlet 14 is increased. This configuration has the effect of causing the mixed fluid "a" to form bubbles.

In addition, the mixed fluid that has been introduced through the inlet 12 first collides against the inner container member 20. A description is given of a first collision section 30 as follows.

The first collision section 30 has a circular cross-section, and is provided in the direction toward the inlet 12 of the inner container member 20. The mixed fluid "a" that has been introduced through the inlet 12 collides against the front surface of the first collision section 30 and is thus stirred, thereby generating microbubbles.

The second collision section 40 has an "L" shape, and is provided on the inner corner of the body 10 adjacent to the outlet 14. The mixed fluid "a" that has been introduced through the inlet 12 and has passed through the passage 19 collides against the second collision section 40 and is thus stirred, thereby further generating microbubbles.

In addition, the first collision section 30 and the second collision section 40 are characterized by protrusions which are formed on the outer surface thereof. As shown in the detailed view of the inner container member in FIG. 3, a plurality of protrusions are formed such that the mixed fluid "a" can collide against the protrusions, thereby activating creation of microbubbles.

In addition, through-holes 18 by which the diameter and concentration of microbubbles can be adjusted are formed in the outer circumference of the body 10. Also provided is a flow rate adjustment member 50 with which the size of the opened area of the through-holes 18 is adjusted, which will be described as follows.

The through-holes 18 are formed in the outer circumference of the body 10 such that liquid can enter the body 10 through them. The number of the through-holes 18 is one or more, and can be suitably determined depending on the environment and the object of use.

In an embodiment of the invention, the through-holes 18 are formed at opposite positions such that the diameter and the concentration of microbubbles can be adjusted in both directions.

Considering that the apparatus for generating microbubbles in water of the invention is constructed in water, it is apparent that liquid can enter the body 10 through the through-holes 18 formed in the body 10.

The flow rate adjustment member 50 is also provided on the outer circumference of the body 10, and is horizontally movable along the outer circumferential surface of the body 10. The flow rate adjustment member 50 enables the through-holes 18 to be closed or opened, thereby adjusting the size of the opened area of the through-holes 18.

Here, it is preferred that the flow rate adjustment member 50 and the body 10 be screw-coupled or slidably coupled to each other such that the flow rate adjustment member 50 can horizontally move on the outer circumference of the body 10.

This makes it possible to variably adjust the inner volume of the body 10, and the volume change and the follow rate have a correlation of being inverse proportional.

Specifically, when the flow rate adjustment member 50 has closed the through-holes 18, the flow rate of the mixed fluid "a" becomes faster, thereby increasing the stirring effect.

In an example, microbubbles that are generated when the through-holes 18 are opened have a diameter of about 10 μm and a concentration of bubbles of about 1,200 per 1 ml. In contrast, microbubbles that are generated when the through-holes 18 are closed have a diameter of about 1 μm and a concentration of bubbles of about 12,000 per 1 ml, which is as much as 10 times the number of microbubbles in the opened state.

Consequently, it is possible to suitably adjust the diameter and concentration of bubbles using the through-holes 18 and the flow rate adjustment member 50.

Here, reference numeral 17 is a blocking section which stops the movement of the flow rate adjustment member 50.

FIG. 3 shows the first collision section 30 provided in the inner container member 20 and the fixing member 22 provided on the outer circumference of the inner container member 20, and FIG. 4 shows the flow rate adjustment member 50 and the blocking section 17 which are provided on the outer circumference of the body 10, which are more clearly depicted.

Figure 5:
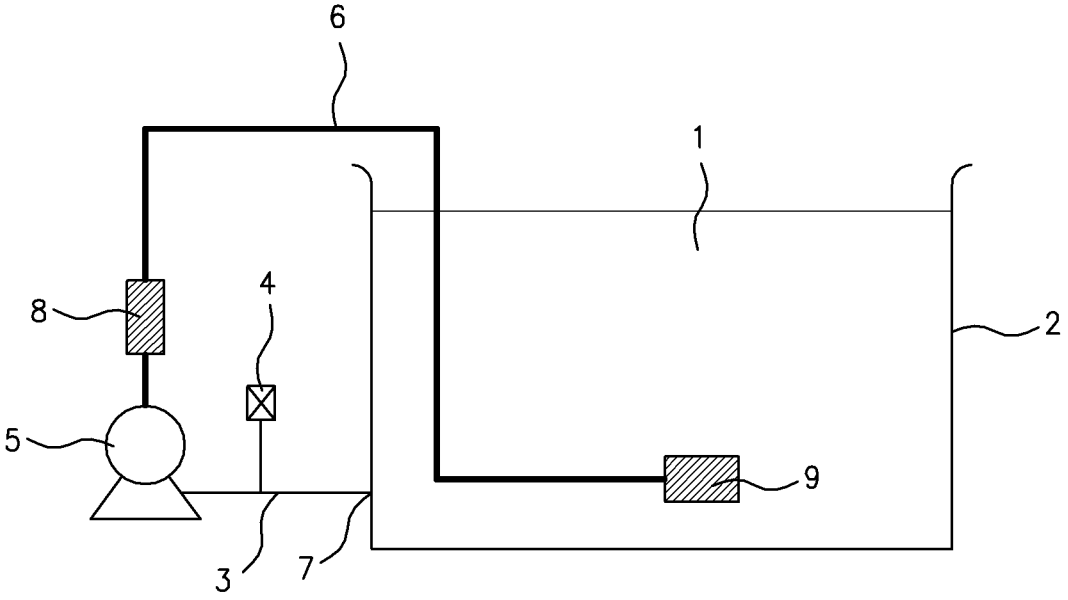
FIG. 5 is an exemplary view in which the apparatus for generating microbubbles in water of the invention is used.

FIG. 5 is an example view in which the apparatus for generating microbubbles in water of the invention is used.

Referring to FIG. 5, the apparatus for generating microbubbles in water 9 of the present invention is constructed in a water tank 2 which contains liquid 1 therein.

A gas capacity regulator 4 which takes in natural air, a pump 5 which pressurizes liquid which is mixed with gas, and a pressure tank 8 are sequentially connected to an inlet 7 of the water tank 2.

Here, reference numeral 3 is an intake duct, and reference numeral 6 is a discharge tube through which the mixed fluid is discharged. The intake duct 3 and the discharge tube 6 are connected to an inlet of the apparatus for generating microbubbles in water 9 so as to provide the mixed fluid thereto.

As for the concentration of bubbles, it is possible to use the pump 5 having a high space to volume ratio and set the concentration of bubbles depending on the gas capacitance regulator 4 which is suitable for the purpose of use.

In addition, the pressure tank 8 can be freely selected by a user as long as it can dissolve gas into water, seawater, or the like.

Therefore, the apparatus for generating microbubbles in water of the present invention promotes creation of microbubbles by adjusting the flow rate of a mixed fluid that is introduced into the body, and enhances creation of microbubbles by causing the mixed fluid to collide against the first and second collision sections positioned inside the body and thus be stirred. In particular, there is an advantage in that the diameter and concentration of microbubbles can be suitably adjusted by providing the through-holes in the outer circumference of the body and adjusting the size of the opened area of the through-holes.

It can be understood that the present invention has fundamental technical principles that the size and concentration of microbubbles can be adjusted by changing the inner volume of the body and adjusting the flow rate, and that the apparatus can be used depending on the purpose of the user. It is of course to be understood that various changes are possible by a person having ordinary skill in the art without departing from the fundamental technical principles of the present invention.

What is claimed is:

1. An apparatus for generating microbubbles in liquid using a mixed fluid supplied from outside, the mixed fluid having a gas and a liquid mixed together, the apparatus comprising:

a body having a cylindrical shape, wherein the body comprises an inlet in one side thereof which is coupled to a conduit through which the mixed fluid is introduced, an outlet in the other side thereof, and a cylindrical space section defined therein, a diameter of the space section being greater than each diameter of the inlet and the outlet;

an inner container member installed in the space section such that a tubular passage is formed around the inner container member;

a first collision section having a circular shape, wherein the first collision section is provided on the inner container member in an inlet side direction such that the mixed fluid introduced through the inlet collides against the first collision section and is stirred; and a second collision section having an "L" shaped cross-section, wherein the second collision section is provided at an inner surface of the body adjacent to the outlet such that the mixed fluid introduced through the inlet and passed through the tubular passage collides against the second collision section and is stirred, wherein each of the first and second collision sections has protrusions on an outer surface thereof.

2. An apparatus for generating microbubbles in liquid using a mixed fluid supplied from outside, the mixed fluid having a gas and a liquid mixed together, the apparatus comprising:

a body having a cylindrical shape, wherein the body comprises an inlet in one side thereof which is coupled to a conduit through which the mixed fluid is introduced, an outlet in the other side thereof, and a cylindrical space section defined therein, a diameter of the space section being greater than each diameter of the inlet and the outlet;

an inner container member installed in the space section such that a tubular passage is formed around the inner container member;

a first collision section having a circular shape, wherein the first collision section is provided on the inner container member in an inlet side direction such that the mixed fluid introduced through the inlet collides against the first collision section and is stirred; and a second collision section having an "L" shaped cross-section, wherein the second collision section is provided at an inner surface of the body adjacent to the outlet such that the mixed fluid introduced through the inlet and passed through the tubular passage collides against the second collision section and is stirred, wherein a through-hole is formed in an outer circumference of the body, and wherein a tubular flow rate adjustment member is provided on the outer circumference of the body and is horizontally movable along the outer circumference of the body so as to close or open the through-hole.

* * * * *